United States Patent [19]

Koboshi et al.

[11] Patent Number: 5,015,560

[45] Date of Patent: May 14, 1991

[54] METHOD OF TREATING PHOTOGRAPHIC WASTE

[75] Inventors: Shigeharu Koboshi, Sagamihara; kazuhiro Kobayashi; Syozo Aoki, both of Tokyo; Naoki Takabayashi, Tokyo, all of Japan

[73] Assignee: Konishiroku Photo Industry Co., Ltd., Tokyo, Japan

[21] Appl. No.: 296,323

[22] Filed: Jan. 10, 1989

Related U.S. Application Data

[63] Continuation of Ser. No. 154,526, Feb. 5, 1988, abandoned, which is a continuation of Ser. No. 848,035, Apr. 4, 1986, abandoned.

[30] Foreign Application Priority Data

Apr. 5, 1985 [JP] Japan ..... 60-73222

[51] Int. Cl.[5] ..... G03C 11/24

[52] U.S. Cl. ..... 430/398; 430/399; 430/400; 430/432; 430/444; 210/681; 210/692; 423/25

[58] Field of Search ..... 430/398, 399, 400, 432, 430/444; 210/681, 692, 770; 75/101 BE, 118 R

[56] References Cited

U.S. PATENT DOCUMENTS

| | | | |
|---|---|---|---|
| 4,043,901 | 8/1977 | Shimamura et al. | 430/398 X |
| 4,134,863 | 1/1979 | Fanta et al. | 210/770 |
| 4,168,971 | 9/1979 | Szczepanski | 75/101 BEX |
| 4,578,195 | 3/1986 | Moore et al. | 210/681 X |
| 4,606,827 | 8/1986 | Ernston et al. | 430/399 X |

FOREIGN PATENT DOCUMENTS

| | | | |
|---|---|---|---|
| 0096831 | 8/1978 | Japan | 430/399 |
| 0014240 | 1/1985 | Japan | 430/398 |

OTHER PUBLICATIONS

"Silver Recovery from Water with Ion Exchange", Journal of Applied Photographic Engineering, vol. 6, No. 1, Feb. 1980, pp. 14–18, Chou.

Ion-Exchange Resins for General Use, Amberlite, Organo Co., Ltd. of Japan, Feb. 1984.

*Primary Examiner*—Hoa Van Le

*Attorney, Agent, or Firm*—Finnegan, Henderson, Farabow, Garrett & Dunner

[57] ABSTRACT

A method of treating a waste solution resulting from the processing of a photographic material with a working solution is disclosed, wherein at least part of said waste solution is absorbed by a resin capable of absorbing at least 50 times its own weight of a liquid.

18 Claims, 2 Drawing Sheets

METHOD OF TREATING PHOTOGRAPHIC WASTE

This application is a continuation of application Ser. No. 07/154,526, filed Feb. 2, 1988, now abandoned, which is a continuation of Ser. No. 06,848,035, filed Apr. 4, 1986 now abandoned.

FIELD OF THE INVENTION

The present invention relates to a method of treating the waste solution which results from photographic processing, as well as an automatic photograph processor. More particularly, the present invention relates to a method adapted to the treatment of the waste solution discharged from an automatic developer in which a silver halide photographic material is being worked, as well as the automatic photograph processor suitable for use with this method.

BACKGROUND OF THE INVENTION

Photographic processing of a silver halide photographic material generally contains steps of development, fixing, washing and so on if the material is a black-and-white light-sensitive material, and involves steps of color development, bleaching, fixing, washing, stabilization, etc. if a color light-sensitive material is to be processed. The working solutions employed in either case have the ability to perform one or more photographic functions.

In processing a large amount of light-sensitive material, it is customary to keep the make-up and hence the performance of each working solution constant not only by compensating for the components consumed in a specific step but also by eliminating any component in the working solution which increases in amount (e.g., bromide ions in the developing solution and silver complex salts in the fixing bath). In order to compensate for the consumed component, a replenishing solution is added to a specific working solution, and for the purpose of eliminating the excess of the component which has increased in amount, part of the working solution is discarded.

Primarily for environmental and economic reasons, concerted efforts are being made by modern photofinishers to drastically reduce the use of replenishers including the washing water which is a replenisher for the washing step. Even in this modern system, the waste working solution is discharged from each of the tanks in the automatic developer and, after being guided through a drain pipe, the solution is diluted with the waste washing water for disposal in sewage or other appropriate places.

With a view to coping with limited water resources and the increased cost of water feeding and drainage and in order to provide ease in the installation of the automatic processor and to improve the working environment around the machine, photographic processing with a water-less automatic processor has been designed and is gaining commercial acceptance.

This machine performs a stabilizing step as an alternative to washing and requires no water feed/drain piping other than what is installed within the machine. It is generally understood that in this sort of photographic processing, the use of cooling water for stabilizing the temperature of working solutions is also desirably reduced. The effluent from the water-less automatic developer is comprised solely of the replenished waste working solutions and is much smaller in amount than when a washing step is included in the process. Because of this feature, the need for installing pipes for water feeding and drainage is eliminated and all of the following problems associated with the conventional types of automatic developer can be solved: a machine with water pipes is difficult to replace after installation; the machine reduces the amount of floor space available for free movement of the operator; additional costs are incurred in attaching pipes to the machine after it is installed in the proper place; and energy costs with feeding hot water are comparatively high. The water-less automatic processor is free from these disadvantages and its small size and operational simplicity will allow its use as an office machine.

However, processing with such water-less automatic processor results in the discharge of fairly large quantities of waste solutions; even in a comparatively small-scale operation, the daily effluents are no less than 10 liters for the processing of X-ray light-sensitive materials, 30 liters for platemaking light-sensitive materials, and 30 liters for color photographic materials. In the absence of external water pipes, the treatment of the effluents from the water-less automatic developer is relatively complicated; first of all, when a certain waste solution tank in the developer is filled with the waste solution, this event must be detected either with a sensor or by visual checking so as to allow for a timely replacement of the tank, and if this is not done, the waste solution will overflow the tank and foul the floor, thereby cancelling the advantages offered by the water-less automatic processor (i.e., the machine does not have to be equipped with external piping and can be installed on a clean floor or a carpeted floor). Aside from the high cost of the sensor, processing with the water-less automatic processor involves one major problem associated with aesthetic appeal in that the container for accommodating the recovered waste solution is more likely to be fouled than when the waste solution is discharged into sewage through the drain pipe.

Most of the photographic processing solutions used today contain easily oxidizable components and are liable to form tar or precipitates as a result of aerial contact during storage. If, as in the usual practice, two or more working waste solutions are recovered in the waste solution tank, the chance of oxidation or precipitation is further increased to form tar or precipitates which are deposited on the bottom or side wall of the tank and will solidify to foul or otherwise degrade the working environment. The tendency of tar formation is particularly great in waste solutions containing hydroquinones or phenidones (black-and-white developing agents), or phenylenediamine derivatives (color developing agents) and splashes of such waste solution will soil the operator's clothes or cause rashes on his skin. A waste solution containing thiosulfate ions will be oxidized to form a sulfur precipitate. If these two types of waste solution are mixed, the degree of tar formation and precipitation is even more increased, and in the presence of a certain substance such as ethylenediaminetetraacetic acid iron (III) salt, troubles such as the precipitation of iron hydroxide or oxide that will cause considerable difficulty in handling may occur.

The last, but by no means least, problem associated with the processing with the water-less automatic processor is that it discharges an aqueous solution which cannot be immediately disposed of by incineration. A processing system in which no waste washing water occurs will yield waste solutions with high BOD and COD loads which cannot be directly discharged into sewage. The most advantageous way to dispose of such waste liquors is incineration.

SUMMARY OF THE INVENTION

One object, therefore, of the present invention is to provide a novel method of treating photographic waste solutions that cannot be discarded in sewage or other appropriate places.

Another object of the present invention is to provide a simple and safe method that is capable of recovering waste effluents from a water-less automatic processor without using a level sensor or other sophisticated devices and without introducing the possibility of fouling the floor on which the processor is installed.

Still another object of the present invention is to provide a method of treating photographic waste solutions by disposing of or incinerating them as they are put in a flexible container or paper bag.

A further object of the present invention is to provide a method of recovering photographic waste solutions from an automatic processor that permits extended storage of the waste solutions without causing oxidative tar formation or precipitation which will degrade the working environment.

A still further object of the present invention is to provide a method of treating photographic waste solutions by using a resin that will absorb them to give a product that is easy to handle for the purpose of silver recovery.

Another object of the present invention is to provide a compact and clean automatic photograph processor.

The first four objects of the present invention can be accomplished by a method wherein at least part of the waste solution that results from the processing of a photographic material with working solutions is absorbed by a resin.

The fifth object of the present invention can be accomplished by a method comprising a step wherein at least part of the waste solution that results from the processing of a photographic material with working solutions is absorbed by a resin, and a step wherein silver is recovered from the resin.

The sixth object of the present invention can be accomplished by an automatic photograph processor that includes a means for transporting a photographic material and a means for automatically feeding working solutions and which is characterized by having a space wherein at least part of the photographic waste solution is absorbed by a resin.

DETAILED DESCRIPTION OF THE INVENTION

Figure 1:
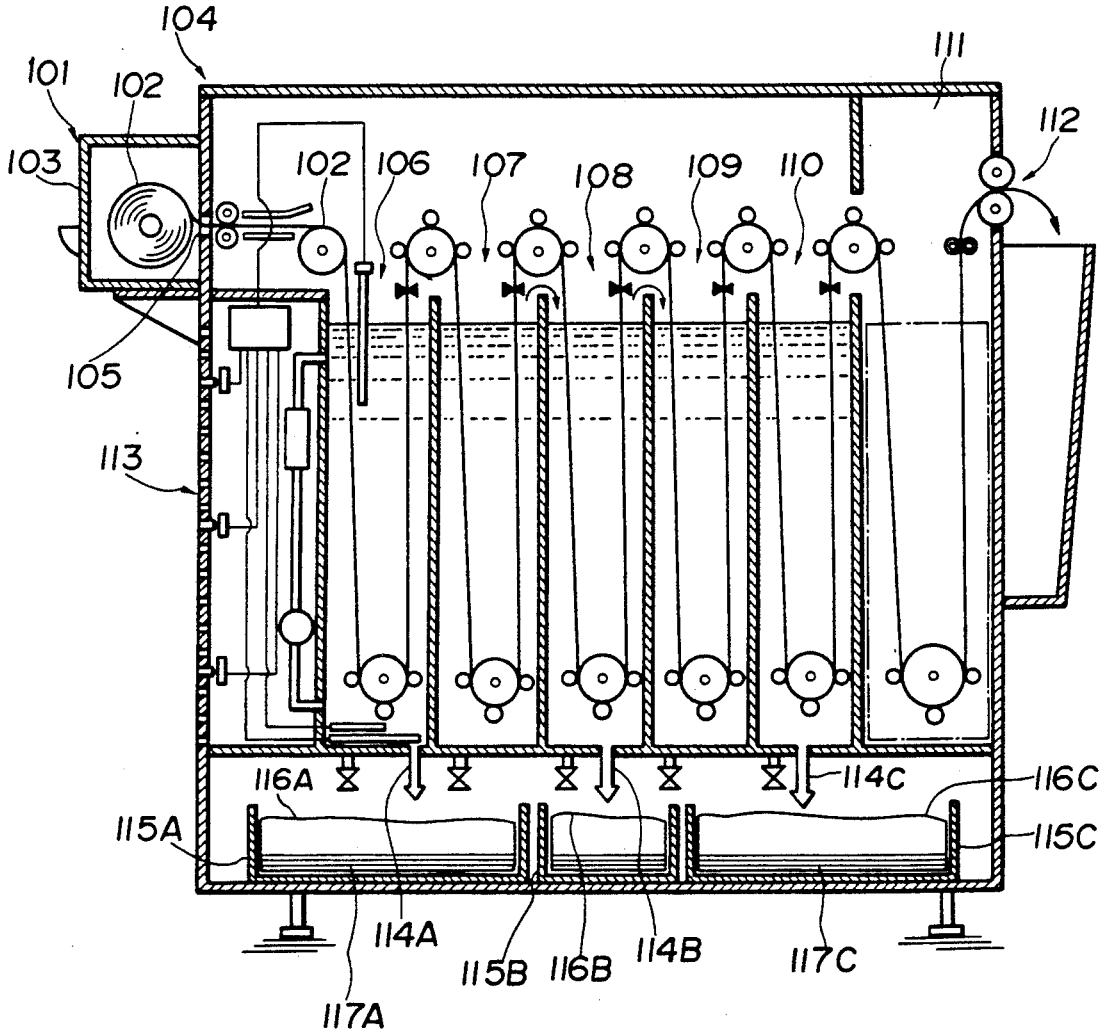
FIG. 1 is a schematic cross section of an automatic processor incorporating one embodiment of the present invention.

Any resin that is capable of absorbing photographic waste liquors may be employed in the present invention, and resins having high liquid absorbing performance are preferably used. Such resins are capable of absorbing at least 30 times their weight of liquids. Preferably, at least 50 times, more preferably at least 100 times, and most preferably at least 500 times, the weight of the resin of liquids should be absorbed. For attaining higher processing efficiencies, the liquid absorbing performance of the resin should be of the highest level possible. The "liquid absorbing ability" is expressed in terms of the weight of a resin sample after swelling upon 5-minute immersion in a photographic waste liquor at ordinary temperatures divided by the weight (1 g) of an unswollen sample.

The photographic waste solutions to be treated by the present invention mean one or more exhausted working solutions having specific gravities of no less than 1.01 such as a black-and-white developing solution, a color developing solution, a fixing bath, a bleach-fixing bath, a bleaching bath, a stabilizing solution, a stop solution, an image stabilizing solution, a rinsing solution, and a washing-replacing stabilizing solution. It should be noted that washing water having a specific gravity of less than 1.01 is excluded from the scope of these "photographic waste solutions".

The liquid absorbing performance depends not only on the liquid absorbing ability but also on the rate of liquid absorption, and the higher the absorption rate, the better. It is desirable that an appropriate resin of high liquid absorbing performance is selected in consideration of both the liquid absorbing ability and the absorption rate.

The resin of "high liquid absorbing performance" desirably has the capability of retaining the photographic waste solution for an extended period; it is also desirable that the resin will not release the absorbed liquid under slight pressure. An inflammable resin is particularly preferable in view of the advantage it offers in post-treatments.

Different photographic waste solutions have different pH ranges: 3–13 for a color developing solution, 3–9 for a bleaching bath and/or a fixing bath, and 2–10 for a washing-replacing stabilization bath. It is therefore preferable that the resin of high liquid absorbing performance used will undergo minimum variations in its absorbing performance in the face of pH variations in each range.

If desired, after the waste solution is absorbed by the resin, water and other volatiles may be evaporated and two or more absorption cycles repeated so as to concentrate the components in the waste solution.

A resin of high liquid absorbing performance that absorbs a specific volume of waste solution and whose volume after swelling remains substantially smaller than said specific volume is advantageous in view of its compactness and, hence, it is this sort which is preferably used in the present invention.

The resins that satisfy the requirements shown above and which may be used as resins of high liquid absorbing performance in the present invention include the following:

- Seed root polysaccharides such as guar gum, locust bean gum, quince seed gum and tara gum;
- seadweed polysaccharides such as carrageenan, alginic acid, furcellaran and agar;
- resin polysaccharides such as gum arabino galactan, gum arabic, tragacanth gum and karaya gum;
- fruit polysaccharides such as pectin;
- tuber polysaccharides such as starch, Konjak mannan and Hibiscus root polysaccaride;
- xanthan gum, zanflo, curdran, succino glucan,syzofiran, pullulan, gelatin, casein, albumin and shellac;

starch derivatives, guar gum derivatives, locust bean gum derivatives, and cellulosic derivatives such as oxidized, carboxymethylated, hydroxyethylated, hydroxypropylated, carboxymethylhydroxypropylated, and aminated celluloses;

alginic acid derivatives such as ammonium alginate and propylene glycol ester of aliginic acid;

vinyl polymers such as POVAL (polyvinyl alcohol), polyvinyl pyrrolidone and polyvinyl methacrylate;

acrylic polymers such as sodium polyacrylate and polyacrylamide; and polyethylene oxide.

Preferred examples of the resin of high liquid absorbing performance suitable for use in the present invention are listed below:

(A) Starch derivatives with graft polymers (A-1) saponification product of starch-acrylonitrile graft polymer; and (A-2) starch-acrylic acid graft polymer.

The starch derivative (A-1) may be prepared by each of the methods described in Unexamined Published Japanese Patent Application No. 43395/1974 and U.S. Pat. No. 4,134,863. The starch derivative (A-2) may be prepared by the method described in Japanese Patent Publication No. 46199/1978.

(B) Acrylic acid polymers (B-1) sodium polyacrylates; and (B-2) vinyl alcohol-acrylic acid copolymers.

The acrylic polymers of the type (B-2) may be subjected to repeated use after natural and/or forced drying.

(C) Polymers having a recurring unit of Formula (I) or (II) shown below, which preferably have 10–70 wt% of (I) and/or (II) and are the products of copolymerization with another ethylenically unsaturated monomer:

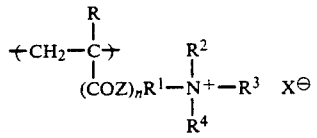

(I)

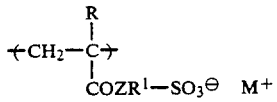

(II)

where R is a hydrogen atom, a methyl group or a halogen atom; Z is an oxy or imino group; n is 0 or 1; $R^1$ is an alkylene group (which may be substituted) having 1–6 carbon atom, a cycloalkylene group having 5 or 6 carbon atoms, or an arylene group, an arylenealkylene group or an arylenebisalkylene group, provided that said alkylene moiety has 1–6 carbon atoms and said arylene moiety (which may be substituted) has 6–10 carbon atoms and may include an arylene substituted by a hydrophilic polar group such as

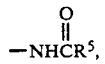

—OH, —C≡N,

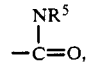

or

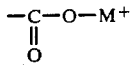

(where $R^5$ has 1–4 carbon atoms); $R^2$, $R^3$ and $R^4$ are each a hydrogen atom or an alkyl group having 1–6 carbon atoms or, when taken together with N, are capable of forming a heterocyclic group optionally containing a sulfur or oxygen atom; $M^+$ is a hydrogen atom, a soluble cation or an ammonium group containing a quaternary ammonium cation having an alkyl group with no more than 6 carbon atoms; and $X^\ominus$ is an acid anion.

The halogen substituent on R may be bromine or chlorine; the alkylene group having 1–6 carbon atoms as represented by $R^1$ may be substituted by a hydroxyl group; the arylene-alkylene group as $R^1$ may be a phenylenemethylene group, a phenyleneethylene group, a phenylenepropylene group or a phenylenebutylene group; and the arylenebisalkylene group as $R^1$ may be a phenylenedimethylene group; the soluble cation as $M^+$ may be sodium or potassium; the heterocyclic group formed by $R^2$, $R^3$ and $R^4$ taken together with the nitrogen atom may be pyridinium, imidazolium, oxazolium, thiazolium or morpholium; and the acid anion as $X^\ominus$ may be a chloride, bromide, acetate, p-toluenesulfonate, methanesulfonate, ethanesulfonate, methyl sulfate, ethyl sulfate or a perchlorate.

Illustrative monomers from which the recurring unit (I) or (II) may be derived include the following:

N-(2-acryloyloxyethyl)-N,N,N-trimethylammonium chloride; N-(2-hydroxy-3-methacryloyloxypropyl)-N,N,N-trimethylammonium chloride;

N-(3-acrylamidopropyl)pyridinium chloride;

N-(2-hydroxy-3-methacryloyloxypropyl)-N,N,N-trimethylammonium chloride;

N-(2-methacryloyloxyethyl)-N,N,N-trimethylammonium iodide;

N-(2-methacryloyloxyethyl)-N,N,N-trimethylammonium p-toluenesulfonate;

N-(2-methacryloyloxyethyl)-N,N,N-trimethylammonium methosulfate;

N-(2-methacryloyloxyethyl)-N,N,N-trimethylammonium acetate;

N-(2-methacryloyloxyethyl)-N,N,N-trimethylammonium bromide;

N-(2-methacryloyloxyethyl)-N,N,N-trimethylammonium chloride;

N-(2-methacryloyloxyethyl)-N,N,N-trimethylammonium ethyl sulfonate;

N-(2-methacryloyloxyethyl)-N,N,N-trimethylammonium nitrate;

N-(2-methacryloyloxyethyl)-N,N,N-trimethylammonium phosphate;

N-(3-acrylamido-3,3-dimethylpropyl)-N,N,N-trimethylammonium methosulfate;

N-vinylbenzyl-N,N,N-trimethylammonium chloride;

N-benzyl-N,N-dimethyl-N-vinylbenzylammonium chloride;

N,N,N-trihexyl-N-vinylbenzylammonium chloride;

N-(2-aminoethyl)methacrylamidohydrochloride;

2-aminoethylmethacrylate hydrochloride;
N-(3-aminopropyl)methacrylamide hydrochloride;
4-(N,N-diethylamino)-1-methylbutylacrylate hydrochloride;
2-(N,N-diethylamino)ethylacrylate hydrochloride;
3-(N,N-diethylamino)ethylmethacrylate hydrochloride;
3-(N,N-diethylamino)propylacrylate hydrochloride;
N-(1,1,3-trimethylaminopropyl)acrylamide hydrochloride;
2-(N,N-dimethylamino)ethylacrylate hydrochloride;
2-(N,N-dimethylamino)ethylmethacrylate hydrochloride;
N-(2-dimethylaminoethyl)acrylamide hydrochloride;
N-(2-dimethylaminoethyl)methacrylamide hydrochloride;
3-(N,N-dimethylamino)propylacrylamide hydrochloride;
sodium 4-acryloyloxybutane-1-sulfonate;
sodium 3-acryloyloxybutane-1-sulfonate;
sodium 3-acryloyloxypropane-1-sulfonate;
sodium 2-acrylamido-2-methylpropane sulfonate;
sodium 3-acrylamidopropane-1-sulfonate;
sodium 2-methacryloyloxyethyl-1-sulfonate;
sodium acryloyloxymethyl sulfonate;
sodium 4-methacryloyloxybutane-1-sulfonate;
sodium 2-methacryloyloxyethane-1-sulfonate;
sodium 3-methacryloyloxypropane-1-sulfonate;
sodium 2-acrylamidopropane-1-sulfonate;
sodium 2-methacrylamido-2-methylpropane-1-sulfonate; and
sodium 3-acrylamido-3-methylbutane-1-sulfonate.

The ethylenically unsaturated monomer that may be copolymerized with the monomer of Formula (I) and/or the monomer of Formula (II) is preferably selected from among the monomers having a crosslinkable group, such as 2-hydroxyethyl methacrylate and 2-hydroxyethyl acrylate, and monomers having an activated methylene group. Illustrative copolymerizable ethylenically unsaturated monomers of this type are shown in U.S. Pat. Nos. 3,459,790, 3,488,708, 3,554,987, 3,658,878, 3,929,482 and 3,939,130.

Polymers that are preferably used in the present invention contain 10–70 wt% of a recurring unit derived from at least one of the monomers in the following list:

2-aminoethylmethacrylate hydrochloride;
N-(2-methacryloyloxyethyl)-N,N,N-trimethylammonium chloride;
N-(2-methacryloyloxyethyl)-N,N,N-trimethylammonium methosulfate;
sodium 2-methacryloyloxyethyl-1-sulfonate; and
2-(N,N-dimethylamino)ethylmethacrylate hydrochloride.

Acid addition salts corresponding to Formula (I) may be converted to free amines by neutralization with bases.

Polymers useful for the purposes of the present invention may be prepared by polymerizing appropriate monomers in an aqueous solution in accordance with routine methods.

Monomers of Formula (I) may be prepared by each of the methods described in R. H. Yocum and E. B. Nyquist ed., Functional Monomers, Marcel Dekker, Inc., New York (1974) and U.S. Pat. No. 2,780,604. Monomers of Formula (II) may be prepared by each of the methods described in U.S. Pat. Nos. 3,024,221 and 3,506,707.

If desired, monomers of Formula (I) or (II) may be prepared by (a) quaternizing amine-containing polymers with an appropriate alkylating agent, or by (b) reacting an amine with a polymer having a group, such as an activated halogen group, that is reactive with said amine. Both techniques are known in the art and are described in U.S. Pat. Nos. 3,488,706 and 3,709,690, and Canadian Patent No. 601,958.

The resins described above may preferably be used in the present invention. Some of them are commercially available resins and they include: Sumika Gel N-100 (Sumitomo Chemical Co., Ltd.), Sumik Gel SP-520 (Sumitomo Chemical Co., Ltd.), Sumika Gel S-50 (Sumitomo Chemical Co., Ltd.), Sumika Gel NP-1020 (Sumitomo Chemical Co., Ltd.), Sumika Gel F-03 (Sumitomo Chemical Co., Ltd.), Sumika Gel F-51 (Sumitomo Chemical Co., Ltd.), Sumika Gel F-75 (Sumitomo Chemical Co., Ltd.), Sunwet IM-300 (Sanyo Chemical Industries, Ltd.), Sunwet IM-1000 (Sanyo Chemical Industries, Ltd.), Aquakeep IOSH-P (Seitetsu Kagaku Co., Ltd.) and Randil F (Japan Exlan Company, Ltd.).

The resins of high liquid absorbing performance used in the present invention preferably have such shapes as facilitating the absorption of waste liquors, and from a handling viewpoint, a powder or particles with diameters of about 0.01–3 mm are advantageous. Resins of such shapes may be directly placed in a waste solution container, or they may be held between sheets of liquid-absorbing or permeable paper or cloth. If desired, the resin may be put in a container such as a box or bag made of liquid-absorbing or permeable paper or cloth, the container then being placed in a separate waste solution container for absorbing the waste working solution. The waste solution container may be made of paper coated with plastics such as polyethylene. This container may be of the foldable type which can be kept within the automatic developer or in a separate location until use. Specific embodiments of the resin of high liquid absorbing performance as applicable to the present invention are described below.

(A) A sheet of the resin is laid in trays for receiving waste solutions collecting at the bottom of an automatic developer, or in a liquid-permeable container (e.g., cloth bag, paper box or a perforated plastic container) which then is placed in each of the trays;

(B) A synthetic resin container in the form of a bottle, bucket or bag, etc. that contains the resin is placed outside the automatic developer, and the waste solution being discharged from the machine is guided to the container through a pipe so that it is absorbed by the resin;

(C) This embodiment is the same as (A) or (B) except that the resin is put in an easily detachable cartridge. In addition to the connective site through which the waste liquor is discharged into the cartridge from the automatic processor, the cartridge preferably has at least one connective site at which it is attached to or detached from the machine. Since the cartridge gains weight considerably after absorbing the waste solution, it is preferably in such a shape that it is supported at the bottom, and in order to ensure easy attachment and detachment of the cartridge, the supporting area is preferably not larger than 70% of the bottom of the cartridge.

(D) The waste solution is guided into an empty container, which is placed within a tray on which a sheet of the resin or a material of high liquid absorbing performance used with said resin (e.g., the resin sandwiched between two tissue sheets) This embodiment has the advantage that the floor will not be fouled even if the waste solution overflows the container, thereby eliminating the need for providing an overflow alarm sensor or automatic valve. If an alarm sensor is necessary, one which is less expensive and more simple in construction than the hitherto required device will suffice.

An apparatus incorporating the concept of the present invention is hereunder described with reference to the accompanying drawings.

FIG. 1 is a schematic cross section of an automatic developer for processing a silver halide color photographic material which can be either a film or paper. In FIG. 1, the numeral 101 denotes a mount by which a magazine 103 accommodating a continuous roll 102 of color negative film or color paper released from a camera is attached to the side wall of the main body of the developer 104.

The unrolled color negative film or color paper 102 is fed into the machine 104 through an inlet 105 and is automatically processed as it passes successively through a color developing tank 106, a fixing tank 107, a bleach-fixing tank 108, a first stabilizing tank 109 and a second stabilizing tank 110; the processed film or paper is dried in a drying section 111 (with a movable lid), recovered from the machine through an outlet 112, and cut to individual frames which are passed through other necessary steps for producing the final product.

The apparatus also includes other components which are not shown and they are tanks for supplying replenishers to the tanks 106 to 110, associated pipes, a pipe for introducing an overflow from the fixing tank 107 into the bleach-fixing tank 108, and a pipe for introducing an overflow from the first stabilizing tank 109 into the bleach-fixing tank 108. Indicated at 113 is a control unit for regulating the temperatures of the working solutions in the respective tanks. Waste working solutions from the tanks 106 to 110 are discharged into respective waste solution containers 115A, 115B and 115 through drain pipes 114A, 114B and 114C, respectively.

The containers 115A, 115B and 115C accommodate containers 116, 116B and 116C which contain resins of high liquid absorbing performance, 117A, 117B and 117C, respectively. Each of the resin containers is made of a flexible plastic film and is perforated in all surfaces.

Figure 2:
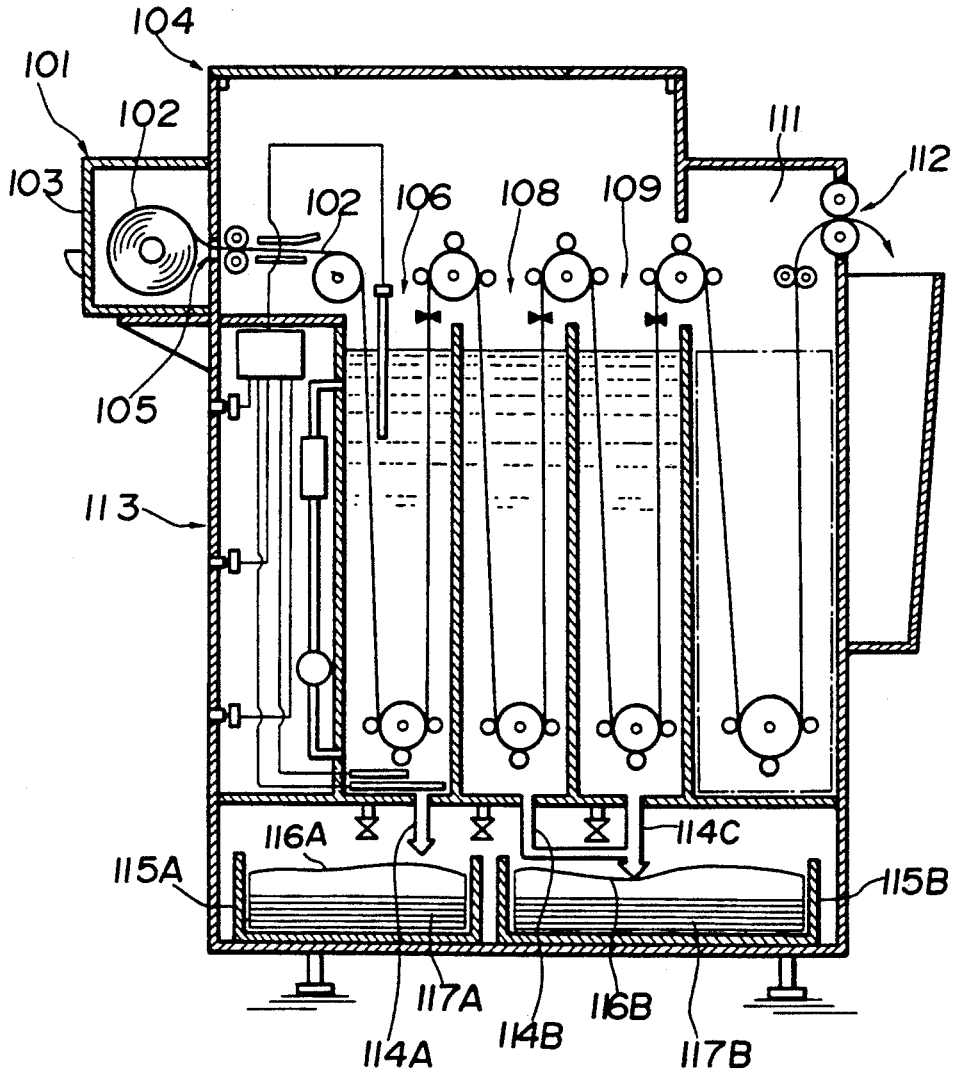
FIG. 2 is a schematic cross section of an automatic processor in accordance with another embodiment of the present invention.

FIG. 2 is a schematic cross section of a modified version of the automatic developer shown in FIG. 1. This machine has only three working tanks, a color developing tank 106, a bleach-fixing tank 108 and a first stabilizing tank 109; an overflow from the color developing tank 106 is guided into a waste solution container 115A through a drain pipe 114A, while both an overflow from the bleach-fixing tank 108 and an overflow from the first stabilizing tank 109 are guided into a waste solution container 115B through drain pipes 114B and 114C, respectively.

The waste solution to be treated by the method of the present invention may result from a known individual working solution used to process a known silver halide photographic material, or may be a mixture of two or more waste solutions resulting from such processing of the photographic material The working solutions that will give rise to the waste solutions to be treated by the present invention include the following.

(1) Color developing bath: This may be a solution with a pH of at least 7 containing one or more of the developing agents, alkali agents, preservatives and other additives to be listed below.

Typical color developing agents are aromatic primary amino color developing agents which include aminophenolic derivatives and p-phenylenediamine derivatives. These derivatives may be in the form of organic or inorganic acid salts, such as hydrochlorides, sulfates, p-toluenesulfonates, sulfites, oxalates and benzenesulfonates. The concentrations of the color developing agents may range from 0.1 to 30 g/l.

Illustrative aminophenolic derivatives include o-aminophenol, p-aminophenol, 5-amino-2-oxy-toluene, 2-amino-3-oxytoluene, and 2-oxy-3-amino-1,4-dimethylbenzene.

Illustrative p-phenylenediamine derivatives are N,N'-dialkyl-p-phenylenediamine compounds such as N,N'-dimethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-$\beta$-methanesulfonamido-ethyl-3-methyl-4-aminoaniline sulfate, N-ethyl-N-$\beta$-hydroxyethylaminoaniline, 4-amino-3-methyl-N,N'-diethylaniline, and 4-amino-N-(2-methoxyethyl)-N-ethyl-3-methylaniline-p-toluenesulfonate.

Illustrative alkali agents include sodium hydroxide, potassium hydroxide, ammonium hydroxide, sodium carbonate, potassium carbonate, sodium sulfate, sodium metaborate, and borax.

Illustrative preservatives include hydroxylamine and sulfites.

Other usable additives include benzyl alcohol and alkali metal halides such as potassium bromide and potassium chloride; development modifiers such as citrazinic acid; anti-foaming agents; surfactants; organic solvents such as methanol, dimethylformamide and dimethylsulfoxide; antioxidants such as diethylhydroxylamine, tetronic acid, tetronimide, 2anilinoethanol, dihydroxyacetone, aromatic secondary alcohols, hydroxamic acid, pentose, hexose and pyrogallol-1,3-dimethyl ether; metal ion sequestering agents in the form of various chelating agents such as aminopolycarboxylic acids (e.g., ethylenediaminetetraacetic acid and diethylenetriaminopentaacetic acid), organic phosphonic acids (e.g., 1-hydroxyethylidene 1,1'-diphosphonic acid), aminopolyphosphonic acids [e.g., aminotri(methylenephosphonic acid) and ethylenediaminetetraphosphoric acid], oxycarboxylic acids (e.g., citric acid and gluconic acid), phosphonocarboxylic acids (e.g., 2-phosphonobutane-1,2,4-tricarboxylic acid), polyphosphoric acids (e.g., tripolyphosphoric acid and hexametaphosphoric acid) and polyhydroxy compounds.

(2) Activator bath: This may be an aqueous solution of one or more of the alkali agents listed in (1).

(3) Bleach bath: This may be a solution with a pH of at least 2.0 containing metal complex salts of organic acids as bleaching agents, wherein metal ions such as iron, cobalt or copper ions are coordinated with organic acids such as polycarboxylic acids, aminopolycarboxylic acids (which may be in the form of alkali metal salts, ammonium salts or water-soluble amine salts), oxalic acid and citric acid. Specific examples of the aminopolycarboxylic acids are listed below.

(1) ethylenediaminetetraacetic acid;

(2) diethylenetriaminepentaacetic acid;

(3) ethylenediamine-N-($\beta$-oxyethyl)-N,N',N'-triacetic acid;

(4) propylenediaminetetraacetic acid;

(5) nitrilotriacetic acid;
(6) cyclohexanediaminetetraacetic acid;
(7) iminodiacetic acid;
(8) dihydroxyethylglycinecitric acid (or -tartaric acid);
(9) ethyletherdiaminetetraacetic acid;
(10) glycoletherdiaminetetraacetic acid;
(11) ethylenediaminetetrapropionic acid;
(12) phenylenediaminetetraacetic acid;
(13) ethylenediaminetetraacetic acid disodium salt;
(14) ethylenediaminetetraacetic acid tetra (trimethylammonium) salt;
(15) ethylenediaminetetraacetic acid tetrasodium salt;
(16) diethylenetriaminepentaacetic acid pentasodium salt;
(17) ethylenediamine-N-(β-oxyethyl)-N,N',N'-triacetic acid sodium salt;
(18) propylenediaminetetraacetic acid sodium salt;
(19) nitrilotriacetic acid sodium salt; and
(20) cyclohexanediaminetetraacetic acid sodium salt.

The bleaching agents listed above are used in amounts generally ranging from 5 to 450 g/1,000 ml, preferably from 20 to 250 g/1,000 ml.

Other usable bleaching baths may contain 5–300 g/1,000 ml of persulfates (e.g., potassium persulfate and sodium persulfate) as bleaching agents.

The bleaching bath may optionally contain a sulfite as a preservative. Another composition that may be used as a bleaching bath contains an ethylenediaminetetraacetic acid iron (III) complex salt as a bleaching agent, plus a major amount of a halide such as ammonium bromide. Other suitable halides include hydrochloric acid, hydrobromic acid, lithium bromide, sodium bromide, potassium bromide, sodium iodide, potassium iodide and ammonium iodide.

The bleaching bath may be a solution with a pH of at least 3.0 that contains a variety of bleaching accelerators as shown in Unexamined Published Japanese Patent Application No. 280/1971; Japanese Patent Publication Nos. 8506/1970 and 556/1971; Belgian Patent No. 770,910; Japanese Patent Publication Nos. 8836/1970 and 9854/1978; and Unexamined Published Japanese Patent Application Nos. 71634/1979 and 42349/1974.

(4) Fixing bath: This may contain 5 g/1,000 ml to the solubility limit of one or more compounds that are customarily used as fixing agents and which will react with silver halides to form water-soluble complex salts. Examples of such compounds include thiosulfates such as potassium thiosulfate, sodium thiosulfate, and ammonium thiosulfate; thiocyanates such as potassium thiocyanate, sodium thiocyanate and ammonium thiocyanate; thiourea and thioether. In addition to these fixing agents, the fixing bath may contain one or more pH buffers selected from the group consisting of boric acid, borax, sodium hydroxide, potassium hydroxide, sodium carbonate, potassium carbonate, sodium bicarbonate, potassium bicarbonate, acetic acid, sodium acetate and ammonium hydroxide; a variety of brighteners, antifoaming agents or surfactants; preservatives such as bisulfite addition products of hydroxylamine, hydrazine or aldehyde compounds; organic chelating agents such as aminopolycarboxylic acids; stabilizers such as nitroalcohol and nitrates; or organic solvents such as methanol, dimethylsulfoamide and dimethylsulfoxide.

(5) Bleach-fix bath: This may be a solution containing about 0.1—about 30 g/1,000 ml of one or more of the metal complex salts of organic acids listed in (3) as bleaching agents and up to the saturated amount of one or more of the fixing agents listed in (4). This solution may further contain a bisulfite as a preservative, or one or more of the pH buffers listed in (4), or it may be a bleach-fix bath with a pH of at least 4.0 containing one or more of the bleaching agents listed in (3). Bleach-fix baths of special compositions may be employed, and they include one containing an ethylenediaminetetraacetic acid iron (III) complex salt as a bleaching agent, one or more of the silver halide fixing agents listed in (4), and a minor amount of a halide such as ammonium bromide, one which contains a major, rather than minor, amount of a halide such as ammonium bromide, and one containing the combination of an ethylenediaminetetraacetic acid iron (III) complex salt as a bleaching agent and a major amount of a halide such as ammonium bromide. Other usable halides include hydrochloric acid, hydrobromic acid, lithium bromide, sodium bromide, potassium bromide, sodium iodide, potassium iodide and ammonium iodide. (6) Stabilizing bath: This may be a solution containing 0.001–1.0 mole of an ammonium compound (e.g., ammonium hydroxide, ammonium bromide, ammonium carbonate, ammonium chloride, ammonium hypo-phosphite, ammonium phosphate, ammonium phosphite, ammonium fluoride, acidic ammonium fluoride, ammonium fluoroborate, ammonium arsenate, ammonium hydrogen carbonate, ammonium hydrogen fluoride, ammonium hydrogen sulfate, ammonium sulfate, ammonium iodide, ammonium nitrate, ammonium penta-borate, ammonium acetate, ammonium adipate, ammonium lauryltricarboxylate, ammonium benzoate, ammonium carbamate, ammonium citrate, ammonium diethyldithiocarbamate, ammonium formate, ammonium hydrogen malate, ammonium hydrogen oxalate, ammonium hydrogen phthalate, ammonium hydrogen tartrate, ammonium thiosulfate, ammonium sulfite, ethylenediaminetetraacetic acid ammonium salt, ethylenediaminetetraacetic acid iron (III) ammonium salt, ammonium lactate, ammonium malate, ammonium maleate, ammonium oxalate, ammonium phthalate, ammonium picrate, ammonium pyrrolidinedithiocarbamate, ammonium salicylate, ammonium succinate, ammonium sulfanilate, ammonium tartrate, ammonium thioglycolate or 2,4,6-trinitrophenol ammonium salt). The stabilizing bath also contains a chelating agent selected from among organic carboxylic acids, organic phosphoric acids, inorganic phosphoric acids, and polyhydroxy compounds, which are illustrated by ethylenediaminediorthohydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, transcyclohexane-di-1'-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphate and sodium hexametaphosphate. These chelating agents may be used in amounts of 0.01 to 50 g per liter of the stabilizing bath. The stabilizing bath may further contain effective amounts of salts of organic acids (e.g., citric acid, acetic acid, succinic acid, oxalic acid and benzoic acid), pH modifiers (e.g., phosphates, borates, hydrochloric acid, and sulfuric acid), mold inhibitors (e.g., phenolic derivatives, catechol derivatives, imidazole derivatives, triazole derivatives, thiabendazole derivatives, organic halogen compounds and any other mold inhibitors commonly employed as slime control agents in the paper pulp industry), brighteners, surfactants, preservatives, and metal salts such as those of Bi, Mg, Zn, Ni, Al, Sn, Ti and Zr.

(7) Black-and-white developing bath: This may be a black-and-white developing solution that is commonly employed with silver halide photographic materials and which contains a developing agent such as 1-phenyl-3-pyrazolidone, methol or hydroquinone, a preservative such as a sulfite, an accelerator made of an alkali such as sodium hydroxide or potassium carbonate, an inorganic or organic restrainer such as potassium bromide, 2-methylbenzimidazole or methylbenzothiazole, a water softener such as a polyphosphate, or an agent for preventing surface overdevelopment which is made of a trace amount of iodide or mercapto compound.

As mentioned earlier in this specification, photographic waste solutions containing developing agents (paraphenylenediamine derivatives, in particular) and/or thiosulfate ions will form tar or precipitates if they remain untreated. These problems can be effectively solved by absorbing such waste solutions by resins of high liquid absorbing performance in accordance with the present invention. This will also solve the problem of the waste solution splashing which will foul the operator's cloths or cause rashes on his skin.

In the practice of the present invention, each of the waste working solutions may be absorbed by a different resin, or two or more waste solutions may be absorbed by one resin and another group of waste solutions are treated by another resin. The following are preferred embodiments for implementing the present invention.

(A) Color Photographic Processing (1)

Steps: Color Development, Bleach-Fixing, and First Stabilization

The waste solution from the step of color development is absorbed by one resin of high liquid absorbing performance while the waste solutions from the steps of bleach-fixing and stabilization are combined and treated by a separate resin.

(B) Color Photographic Processing (2)

Steps: Color Development, Bleaching, Fixing, First Stabilization, and Second Stabilization The waste solutions from the steps of color development, bleaching and second stabilization are combined and absorbed by a resin of high liquid absorbing performance while the waste solutions from the steps of fixing and first stabilization are combined and treated by a separate resin.

(C) Color Photographic Processing (3)

Steps: Color Development, Prefixing, Bleach-Fixing, First Stabilization, and Second Stabilization The waste solution from the step of color development and that from the step of second stabilization are absorbed by separate resins of high liquid absorbing performance. Overflows from the prefixing and first stabilizing tanks are directed into the bleach-fixing tank and the waste solution therefrom is absorbed by a separate resin.

(D) Black-and-White Photographic Processing

Steps: Development, Fixing and Washing

The waste solutions from the steps of development and fixing are absorbed by separate resins of high liquid absorbing performance, while the waste washing water is discharged into sewage.

These embodiments may be modified in an appropriate manner if one wants to apply the present invention to photographic processing schemes other than those specified above.

The resin of high liquid absorbing performance that has absorbed a specific waste solution or a material of high liquid absorbing performance containing said resin is in a general case directly discarded or incinerated. If desired, they may be discarded or incinerated after performing a post-treatment such as evaporation or dehydration. If the waste liquor contains silver ions, the resin is preferably subjected to silver recovery. Silver may be recovered from the ash of the residue left after incinerating the resin. Alternatively, the silver in the ash may be dissolved in nitric acid and the solution is electrolyzed to recover the silver.

The present invention is particularly effective in solving the aforementioned problems associated with an automatic processor that is not equipped with any pipes for feeding washing water or for feeding and draining cooling water. The concept of the invention is also effective in photographic processing with an automatic processor of the type from which part of the waste solutions cannot be discharged into sewage or any other appropriate places, or even in processing without an automatic processor. The photographic materials that can be uscd in the practice of the present invention are not limited to silver halide photographic materials and may be any type of the photographic material that is processed by working solutions and which will yield waste solutions that can be absorbed by resins of high liquid absorbing performance The following examples are provided for the purpose of further illustrating the present invention but are by no means intended as limiting.

EXAMPLE 1

A sample of color paper was prepared by conventional methods. The silver halide was silver chlorobromide (with 25 mol% of AgCl), which was applied to a base of polyethylenecoated paper to give a silver coating weight of 10 mg/100 $cm^2$, and the web was dried. The thus prepared sample was exposed in a color printer and processed by the following scheme in an automatic processor having the basic design shown in FIG. 2.

Steps

| | | |
|---|---|---|
| (1) color development | 38° C. | 3 min and 30 sec |
| (2) bleach-fixing | 38° C. | 1 min and 30 sec |
| (3) stabilizing | 33° C. | 3 min |
| (4) drying | 75-80° C. | ca. 2 min |

Formulations

Color Developing Bath

| | |
|---|---|
| Benzyl alcohol | 15 ml |
| Ethylene glycol | 15 ml |

-continued

| | |
|---|---|
| Potassium sulfite | 2.0 g |
| Potassium bromide | 1.3 g |
| Sodium chloride | 0.2 g |
| Potassium carbonate | 30.0 g |
| Hydroxylamine sulfate | 3.0 g |
| 1-Hydroxyethylidene-1,1-diphosphic acid | 0.6 g |
| Magnesium chloride | 0.9 g |
| 3-Methyl-4-amino-N-ethyl-N-(β-methanesulfonamidoethyl)aniline sulfate | 5.5 g |
| Brightner (Kaycol PK-C of Shin-nisso Kako, Ltd.) | 1.0 g |
| Water (pH adjusted to 10.20 by addition of potassium hydroxide) | to make 1,000 ml |

Color Developing Replenisher

| | |
|---|---|
| Benzyl alcohol | 20 ml |
| Ethylene glycol | 20 ml |
| Potassium sulfite | 3.0 g |
| Potassium carbonate | 30.0 g |
| Hydroxylamine sulfate | 4.0 g |
| 3-Methyl-4-amino-N-ethyl-N-(β-methane-sulfonamidoethyl)aniline sulfate | 7.5 g |
| 1-Hydroxyethylidene-1,1-diphosphonic acid | 0.6 g |
| Magnesium chloride | 0.9 g |
| Brightner (Kaycol PK-C of Shin-nisso Kako, Ltd.) | 1.0 g |
| Water (pH adjusted to 10.7 by addition of potassium hydroxide or 50% sulfuric acid) | to make 1,000 ml |

Bleach-Fixing Bath and Replenisher

| | |
|---|---|
| Ethylenediaminetetra acetic acid iron (III) ammonium dihydrate | 60 g |
| Ethylenediaminetetra acetic acid | 3 g |
| Ammonium thiosulfate (70% sol.) | 100 ml |
| Ammonium sulfite (40% sol.) | 27.5 ml |
| Water (pH adjusted to 7.10 by addition of potassium carbonate) | to make 1,000 ml |

Stabilizing Bath and Replenisher

| | |
|---|---|
| Sodium benzoate | 0.5 g |
| 1-Hydroxyethylidene-1,1-diphosphonic acid | 1.0 g |
| Magnesium chloride | 0.7 g |
| Polyvinylpyrrolidone | 0.1 g |
| Ammonium hydroxide (28% aq. sol.) (pH adjusted to 7.1 by addition of acetic acid and potassium hydroxide) | 3.0 g |

In accordance with the scheme shown above, 1,000 color prints of the cabinet size (12×16.5 cm) were continuously processed per 1,000 ml. In water-less developing system, it is recommended that ratio of the capacity of the container for waste color developing solution to that of the container for waste bleach-fixing and stabilizing solutions should be within the range of 1:6 to 2:3, and in the Example shown, the capacities of the first and second containers were 2 and 6 liters, respectively. The volume of the waste color developing solution amounted to 2,000 ml while that of the waste bleach-fixing and stabilizing solutions combined was 6,200 ml. The bleach-fixing and stabilizing solutions spilled from the conventional container using no absorber resin, thereby fouling the working environment. The container of the waste color developing solution could be taken out of the automatic developer without causing any spillage but this was possible only after great care and prolonged time were spent.

The same experiment was conducted with 7 g of Sumika Gel S-50 put in the container for waste color developing solution and 25 g of the same gel in the container for combined waste bleach-fixing and stabilizing solutions. A thousand color papers of the cabinet size could be smoothly processed without fouling the working environment. In addition, both containers could be replaced in a short time without fouling the operator's hands or clothes.

An additional 200 color prints were processed by the method of the present invention and, surprisingly enough, no spillage of waste working solutions occurred and the working environment was kept clean. The resins which had absorbed the waste working solutions could be left for a week without causing any tar formation or precipitation.

EXAMPLE 2

The resins that had absorbed the waste working solutions resulting from the processing of 1,000 color prints in Example 1 could be readily incinerated at 700°-1,000° C. The silver in the working solutions could be recovered from the ash in the incineration residue. In an alternative method, the silver in the ash was dissolved in nitric acid and the solution was electrolyzed for silver recovery In accordance with the present invention, waste photographic working solutions are absorbed by resins of high liquid absorbing performance to produce a solid form which is easy to handle and can be discarded or incinerated as it is put in a flexible container or paper bag. Unlike the conventional method which handles waste solutions in a liquid form, the method of the present invention allows the waste solutions to be recovered safely without causing splashes. Furthermore, since containers for the waste solutions can be increased in size both horizontally and vertically, a larger accommodation capacity can be readily attained, thereby minimizing the need for using an alarm sensor or the possibility of the waste solutions fouling the floor on which the automatic processor is installed.

What is claimed is;

1. In a method of treating a waste solution resulting from the processing of a photographic material with a working solution, the improvement wherein at least part of said waste solution is absorbed by a resin which is capable of absorbing at least 30 times its own weight of a liquid.

2. A method according to claim 1 wherein said resin is capable of absorbing at least 50 times its own weight of a liquid.

3. A method according to claim 1 wherein said waste solution contains one or both of p-phenylenediamine derivative ions and thiosulfate ions.

4. A method according to claim 1 wherein said resin is inflammable.

5. A method of treating a waste solution resulting from the processing of a photographic material with a working solution, said method comprising a step wherein at least part of the waste solution is absorbed by a resin which is capable of absorbing at least 30 times its own weight of a liquid, and a step wherein silver is recovered from the resin.

6. A method according to claim 5 wherein said resin is inflammable.

7. A method according to claim 5 wherein said resin is capable of absorbing at least 50 times its own weight of a liquid.

8. A method according to claim 5 wherein said resin is capable of absorbing a specific volume at least 30 times its own weight of said liquid and wherein the volume of said resin after swelling remains substantially smaller than said specific volume.

9. A method according to claim 5 wherein said resin after absorbing said waste solution is discarded or incinerated.

10. A method according to claim 9 wherein said resin is placed in a waste solution container.

11. A method according to claim 10 wherein said resin is placed in a liquid permeable container before being placed in said waste solution container.

12. A method according to claim 1 wherein said resin is capable of absorbing a specific volume at least 30 times its own weight of said liquid and wherein the volume of said resin after swelling remains substantially smaller than said specific volume.

13. A method according to claim 1 wherein said resin after absorbing said waste solution is discarded or incinerated.

14. A method according to claim 13 wherein said resin is placed in a waste solution container.

15. A method according to claim 14 wherein said resin is placed in a liquid permeable container before being placed in said waste solution container.

16. In a method of treating a waste solution resulting from the processing of a photographic material with a working solution, the improvement wherein at least part of said waste solution is absorbed by a resin selected from the group consisting of guar gum, locust bean gum, quince seed gum, tara gum, carrageenan, alginic acid, furcellaran, agar, gum arabino galactan, gum arabic, tragacanth gum, karaya gum, pectin, starch, Konjak mannan, Hibiscus root polysaccaride, santhan gum, zanflo, curdran, succino glucan, syzofiran, pullulan, gelatin, casein, albumin, shellac, a cellulosic derivative selected from oxidized, carboxymethylated, hydroxyethylated, hydroxypropylated, carboxymethylhydroxypropylated, and aminated celluloses, ammonium alginate, propylene glycol ester of aliginic acid, polyvinyl alcohol, polyvinyl pyrrolidone, polyvinyl methacrylate, sodium polyacrylate, polyacrylamide, polyethylene oxide, the saponification product of a starch-acrylonitrile graft polymer, a starch-acrylic acid graft polymer, a sodium polyacrylate, a vinyl alcohol-acrylic acid copolymer, and a polymer having a recurring unit of formula (I) or formula (II) which is the product of copolymerization with another ethylenically unsaturated monomer:

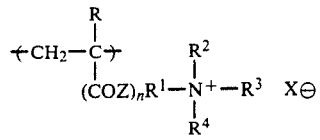

(I)

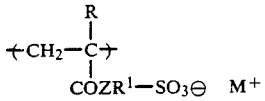

(II)

wherein R is hydrogen, methyl, bromine or chlorine; Z is oxy or imino, n is 0or 1; $R^1$ is alkylene having 1–6 carbon atom or said alkylene substituted by hydroxyl, cycloalkylene having 5 or 6 carbon atoms, arylene, arylenealkylene or arylenebisalkylene, with the proviso that said alkylene moiety has 1–6 carbon atoms and said arylene moiety has 6–10 carbon atoms and includes arylene substituted by a hydrophilic polar group selected from

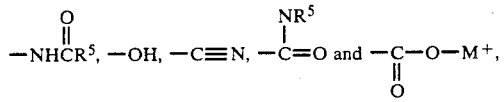

wherein $R^5$ has 1–4 carbon atoms; $R^2$, $R^3$ and $R^4$ are each hydrogen or alkyl having 1–6 carbon atoms or, when taken together with N, form a heterocyclic group selected from pyridinium, imidazolium, oxazolium, thiazolium an dmorpholium; $M^+$ hydrogen, sodium, potassium or an ammonium group containing a quaternary ammonium cation having an alkyl group with no more than 6 carbon atoms; and $X^\ominus$ is a chloride, bromide, acetate, p-toluenesulfonate, methanesulfonate, ethanesulfonate, methyl sulfate, ethyl sulfate or a perchlorate.

17. A method according to claim 5 wherein said liquid is said waste solution.

18. A method according to claim 1 wherein said liquid is said waste solution.

* * * * *